US010844590B2

(12) United States Patent
Tanaka et al.

(10) Patent No.: US 10,844,590 B2
(45) Date of Patent: Nov. 24, 2020

(54) COLUMN BASE STRUCTURE FOR CONSTRUCTION, AND BASE PLATE

(71) Applicant: SENQCIA CORPORATION, Tokyo (JP)

(72) Inventors: Hidenori Tanaka, Funabashi (JP); Kumiko Masuda, Matsudo (JP); Ikumi Hayashi, Kawasaki (JP)

(73) Assignee: SENQCIA CORPORATION, Tokyo (JP)

( * ) Notice: Subject to any disclaimer, the term of this patent is extended or adjusted under 35 U.S.C. 154(b) by 0 days.

(21) Appl. No.: 16/346,867

(22) PCT Filed: Nov. 18, 2016

(86) PCT No.: PCT/JP2016/084297
§ 371 (c)(1),
(2) Date: May 1, 2019

(87) PCT Pub. No.: WO2018/092275
PCT Pub. Date: May 24, 2018

(65) Prior Publication Data

US 2020/0056363 A1 Feb. 20, 2020

(51) Int. Cl.
*E04B 1/24* (2006.01)
*E04B 1/58* (2006.01)

(52) U.S. Cl.
CPC ..... *E04B 1/2403* (2013.01); *E04B 1/58* (2013.01); *E04B 2001/2418* (2013.01); *E04B 2001/2463* (2013.01)

(58) Field of Classification Search
CPC ... E04B 1/2403; E04B 1/58; E04B 2001/2418
See application file for complete search history.

(56) References Cited

U.S. PATENT DOCUMENTS 4,080,768 A * 3/1978 Trixl ..... B29C 65/562 52/521
5,505,033 A * 4/1996 Matsuo ..... E02D 27/42 52/169.9

(Continued)

FOREIGN PATENT DOCUMENTS

JP H06-193144 A 7/1994
JP H09-111770 A 4/1997

(Continued)

OTHER PUBLICATIONS

Feb. 19, 2019 Office Action issued in Japanese Patent Application No. 2015-107333.

(Continued)

*Primary Examiner* — Paola Agudelo
(74) *Attorney, Agent, or Firm* — Oliff PLC

(57) ABSTRACT

A column body (3) is, for example, an H steel column. Abase plate (5) is joined to the lower end of the column body (3). Anchor bolts (9) are inserted into a foundation (7) and are fixed thereto. Slits (13*a*), (13*b*) are provided in the base plate (5). The slits (13*a*), (13*b*) are formed in mutually different directions. The slits (13*a*), (13*b*) are formed so as to surround the anchor bolts (9) (holes of the base plate (5)). More specifically, the anchor bolts (9) are surrounded from a plurality of directions by the slits (13*a*), (13*b*) formed in a plurality of different directions.

6 Claims, 7 Drawing Sheets

(56) References Cited

U.S. PATENT DOCUMENTS

| | | | | |
|---|---|---|---|---|
| 5,901,525 | A * | 5/1999 | Doeringer | E04H 12/2253 248/519 |
| 6,438,904 | B1 * | 8/2002 | Anzai | E02D 27/24 52/167.1 |
| D513,536 | S * | 1/2006 | Walker | D25/133 |
| 7,722,014 | B2 * | 5/2010 | Godwin | E04C 3/32 248/523 |
| 9,422,717 | B2 * | 8/2016 | Tanaka | E04C 3/32 |
| 9,850,676 | B2 * | 12/2017 | Hamilton | E04H 12/2284 |
| 2009/0272053 | A1 * | 11/2009 | Dent | E02D 27/32 52/296 |
| 2014/0230365 | A1 * | 8/2014 | Hemphill | E04C 3/30 52/843 |
| 2015/0259914 | A1 | 9/2015 | Tanaka et al. | |
| 2015/0259918 | A1 | 9/2015 | Tanaka et al. | |

FOREIGN PATENT DOCUMENTS

| | | | |
|---|---|---|---|
| JP | 2002146922 | A | 5/2002 |
| JP | 2009-256885 | A | 11/2009 |
| JP | 2013-064244 | A | 4/2013 |
| JP | 2014-070351 | A | 4/2014 |
| JP | 2015-180798 | A | 10/2015 |
| JP | 2016-223070 | A | 12/2016 |
| WO | 2015/140894 | A1 | 9/2015 |
| WO | 2015140890 | A1 | 9/2015 |

OTHER PUBLICATIONS

Dec. 20, 2016 International Search Report issued in International Patent Application No. PCT/JP2016/084297.

Jun. 1, 2020 Office Action issued in Taiwanese Patent Application No. 10920518320.

* cited by examiner

COLUMN BASE STRUCTURE FOR CONSTRUCTION, AND BASE PLATE

TECHNICAL FIELD OF THE INVENTION

The present invention relates to a column base structure for construction, and a base plate used for the same.

BACKGROUND OF THE INVENTION

As shown in FIG. 7, a common structure 100 includes a column body 101, a beam 105, and so on. The column body 101 is joined to a foundation 103. When a lateral force X is applied to such the structure 100, a bending moment M occurs to the column body 101. In such a case, the maximum bending moment occurs at a joint part between the column body 101 and the foundation 103. For this reason, rigidity that can bear this bending moment is required for the column body 101 and the foundation 103.

As such a joint structure for the foundation 103 at bottom of the column body 101, a method in which a base plate joined to a column base is fixed to the foundation by using anchor bolts is common (Patent Document 1, for example).

RELATED ART

Patent Documents

[Patent Document 1] Japanese Unexamined Patent Application Publication No. 2013-64244 (JP-A-2013-64244)

SUMMARY OF THE INVENTION

Problems to be Solved by the Invention

Here, in mid-to-low rise buildings, while the rigidity of the steel-made column body 101 or the beam 105 is sufficient, the foundation 103 made of concrete lacks in rigidity in some cases. To obtain the foundation 103 that is more robust, the foundation 103 is required to be larger and deeper. For example, since steel material used for the column body 101 is a standardized product, its rigidity is in some cases surplus to requirements for the mid-to-low rise buildings even when the cheapest column body 101 is chosen. On the other hand, a column base structure at the joint part between the foundation 103 and the column body 101 requires rigidity that is sufficient to bear the bending moment, and this has been a cause for an increase in cost.

On the other hand, there is a method in which the joint part between the foundation 103 and the column body 101 is in a pin-connected structure. With a pin-connected structure, the bending moment generated on the column base can be reduced. Thus, the foundation 103 can be much smaller.

In this case, rigidity of the column body 101 and the beam 105 is to counter the bending moment generated by the external force. However, as mentioned above, when the bending moment applied onto the column body 101 and the beam 105 is increased because of the pin-connected structure, the conventional column body 101 and the beam 105 have sufficient rigidity and there is no problem in strength. However, the pin-connected structure requires precision machining and is more expensive than using a common steel-frame column base, which results in high cost.

The present invention was made in view of such problems. Its object is to provide an inexpensive column base structure for construction, and a base plate used for the same.

Means for Solving Problems

To achieve the above object, a first invention is a column base structure for construction including a column body and a base plate that is joined to a lower end of the column body. The base plate is provided with a hole through which an anchor bolt for joining the base plate to a foundation is inserted. A slit is formed in the base plate in vicinity of the anchor bolt at a part that is not a joint part between the base plate and the column body.

The slits are formed in a plurality of different directions, and the anchor bolt may be surrounded from a plurality of directions by the continuous slits in the plurality of directions.

The slits may be formed in at least one direction, and the anchor bolt may be surrounded from a plurality of directions by the slits and an outer side face of the base plate that is continuous with the slits and in a direction different from the direction of the slits.

The anchor bolt is preferably formed within at least one width, in a plan view, of the column body that is to be joined to the base plate.

The anchor bolt may be fixed to the base plate by using nuts from above and below the base plate.

In this case, it is preferable that there is a space formed in at least a part between the base plate and the foundation.

According to the first invention, the slits formed in the base plate help the base plate to deform easily and the column base to rotationally deform easily. Thus, the bending moment generated on the column base can be reduced. Also, this only requires forming slits in the base plate, and thus the structure is not as complicated as the conventional pin-connected structure and is inexpensive.

Such deformation of the base plate can be performed by, for example, forming continuous slits in different directions and surrounding the anchor bolt thereby, which can deform the base plate efficiently in vicinity of a fixing part with the anchor bolt.

Also, instead of surrounding the anchor bolt by slits, the base plate can be efficiently deformed by surrounding the anchor bolt by slits in mutually different directions and an outer side face of the base plate that is continuous with the slits.

Also, the anchor bolt is formed within at least one width of the column body that is to be joined to the base plate. This can increase an amount of rotational deformation of the base plate. That is, bringing the fixing part with the anchor bolt closer to the center of the base plate can rotationally deform the base plate efficiently.

Also, the anchor bolt is fixed from above and below the base plate by using nuts so the base plate never contacts closely to the foundation. Thus, the base plate can deform efficiently.

In particular, if there is a space formed between the base plate and the foundation, the base plate can be deformed efficiently.

A second invention is a base plate including a plate-like main body, a hole, through which an anchor bolt is to be inserted, and a slit formed in vicinity of the hole. The hole and the slit are provided in the main body. The hole is surrounded by the continuous slits in a plurality of mutually different directions, or by the slit and an outer side face of the main body, in which the outer side face is continuous with the slit and in a direction different from the slit.

According to the second invention, the base plate can deform easily and the column base can rotationally deform easily. Thus, the bending moment generated on the column base can be reduced. Also, this only requires forming slits in the base plate, and thus the structure is not as complicated as the conventional pin-connected structure and is inexpensive.

Effects of the Invention

The present invention can provide an inexpensive column base structure for construction, and a base plate used for the same.

DESCRIPTION OF SOME EMBODIMENTS

Figure 1:
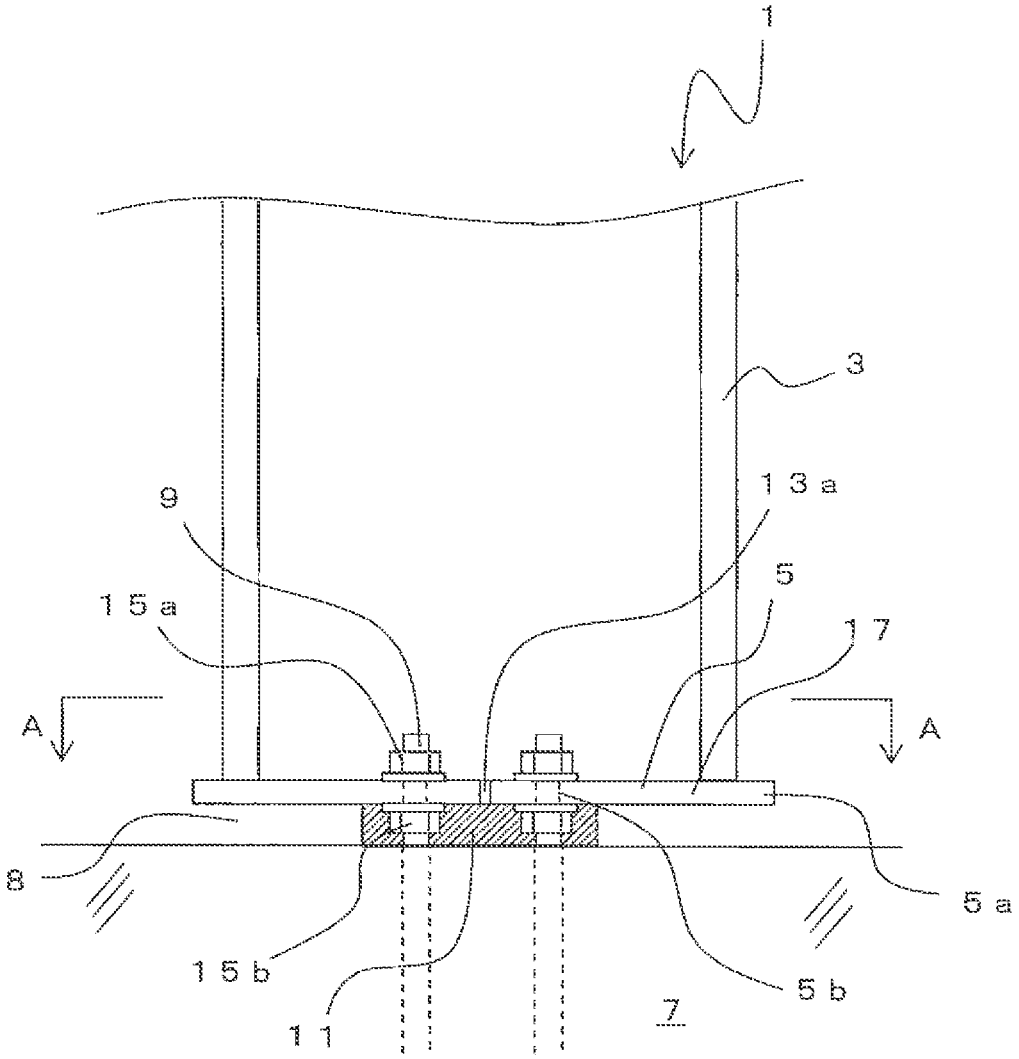
FIG. 1 is a front view showing a column base structure 1.
Figure 2:
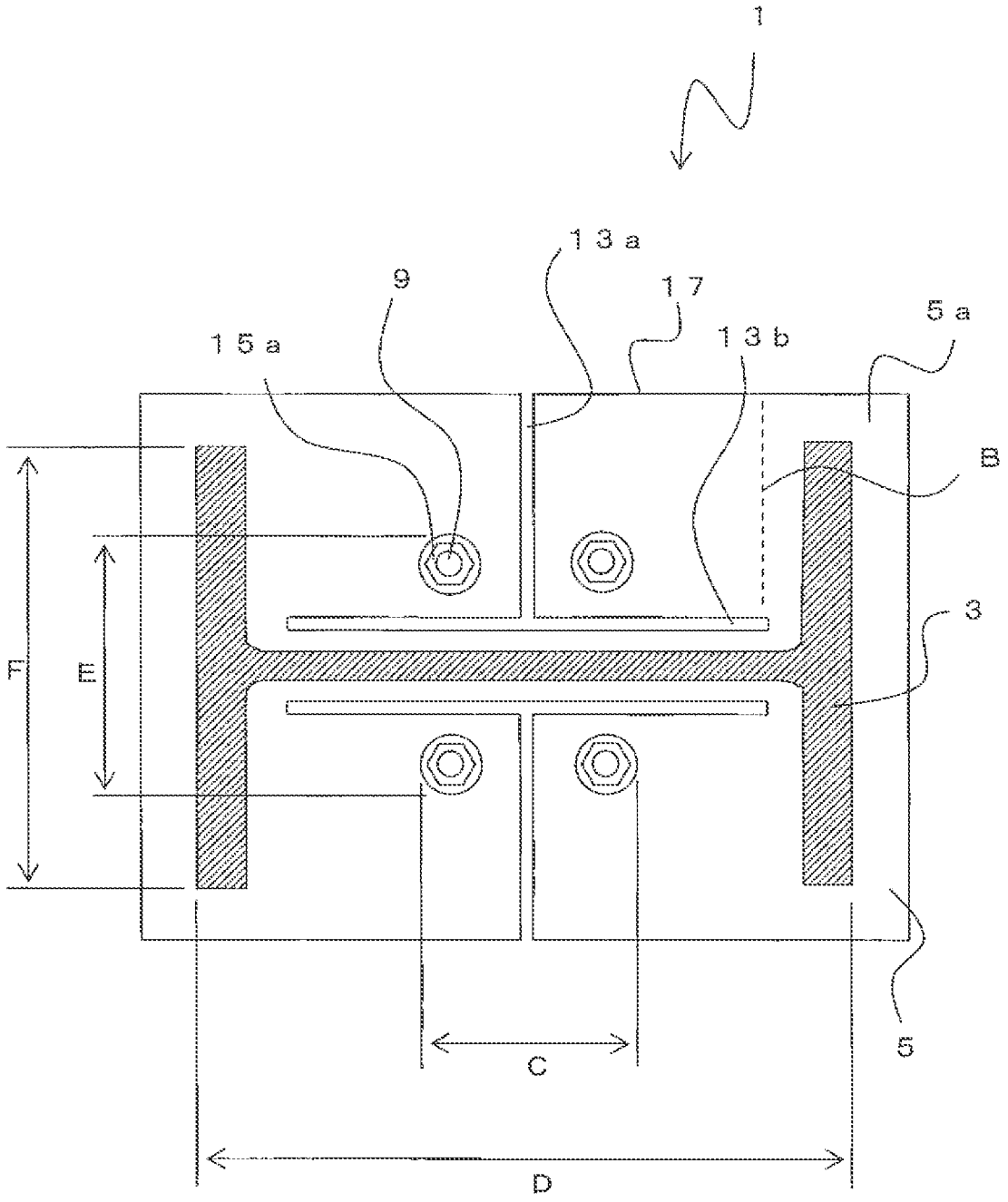
FIG. 2 is a cross sectional view taken along A-A line in FIG. 1 showing the column base structure 1.

Hereinafter, a column base structure 1 according to an embodiment of the present invention will be described. FIG. 1 is a front view showing the column base structure 1 and FIG. 2 is a cross sectional view taken along A-A line in FIG. 1. The column base structure 1 includes a column body 3, a base plate 5, a foundation 7, an anchor bolt 9, and so on.

The column body 3 is an H steel column, for example. The base plate 5 is joined to a lower end of the column body 3. The base plate 5 is a steel-made plate like member. A hole 5*b* is provided in a main body 5*a* of the base plate 5, and the anchor bolt 9 is inserted through the hole 5*b*.

The anchor bolt 9 is inserted into the foundation 7 and fixed. Also, the anchor bolt 9 is interposed by nuts 15*a* and 15*b* from above and below the base plate 5 and is fixed to the base plate 5.

Here, as shown in FIG. 2, in regard to one width of the column body 3 (D in the drawing), the anchor bolt 9 is located within this width (C in the drawing). Similarly, in regard to the other width of the column body 3 (F in the drawing), the anchor bolt 9 is located within this width (E in the drawing). That is, in regard to the widths of the column body 3, the anchor bolt 9 is never located outside the widths. For example, the anchor bolt 9 is disposed in vicinity of a center of the base plate 5. Although the anchor bolt 9 in the illustrated example is not located outside the widths in either directions, it is required that the anchor bolt 9 is disposed within at least one width of the column body 3.

A mortar 11 is provided in part between the base plate 5 and the foundation 7. The nut 15*b* at the bottom is not always necessary and the base plate 5 may be in contact with an upper part of the foundation 7. In this case, the mortar 11 is unnecessary. Also, if the nut 15*b* alone can support the base plate 5 and the column body 3, then the mortar 11 is unnecessary.

The mortar 11 is formed in an area that is slightly larger than an area in which the anchor bolt 9 is disposed. Thus, the mortar 11 is disposed only in vicinity of the center part of the base plate 5, and, on an outer periphery side of the base plate 5, there is a space 8 formed between the base plate 5 and the foundation 7 for at least a thickness of the nut 15*b*.

Slits 13*a* and 13*b* are provided in the base plate 5. The slits 13*a* and 13*b* are formed in directions different from each other. The slit 13*a* is formed as a straight line at substantially middle of a width direction on one side of the base plate 5 in a plan view. The slit 13*a* is formed from an outer side face 17 for a predetermined length (to a position that does not reach a joint part with the column body 3). The slit 13*b* is formed so as to meet the slit 13*a* at substantially right angles and intersect with a tip end of the slit 13*a*. That is, the slits 13*a* and 13*b* are continuous with each other, and the slit 13*a* and the slit 13*b* together form a substantially T shape.

The slits 13*a* and 13*b* are formed so as to surround each of the anchor bolts 9 (the holes in the base plate 5). More specifically, the slits 13*a* and 13*b* formed in a plurality of different directions surround the anchor bolt 9 from a plurality of directions. In the illustrated example, the anchor bolt 9 is surrounded from three directions by the slit 13*a*, the slit 13*b*, and the outer side face 17 that are continuous with each other. The one anchor bolt 9 is disposed in one area surrounded by the slit 13*a*, the 13*b*, and the outer side face 17.

By disposing the anchor bolt 9 between the continuous slits 13*a* and 13*b* or the outer side face 17 in at least two different directions as above, a deformable portion (B in the drawing, for example) is formed on the base plate 5 that is fixed by the anchor bolt 9. The deformable portion is a part that allows the rotational deformation of the column body 3 when an external force occurs to the column body 3, which causes the base plate 5 to deform. In the illustrated example, the deformable portion is formed between a tip end of the slit 13*b* and the outer side face 17 (or between the tip end of the slit 13*b* and a tip end of the slit 13*a*). The deformable portion is also formed for each of the four anchor bolts 9.

For the deformable portion to be formed, the anchor bolt 9 may be surrounded from a plurality of directions by the continuous slits in a plurality of directions. Alternatively, the anchor bolt 9 may be surrounded from a plurality of directions by the slit, which is formed in at least one direction, and the outer side face 17 of the base plate, which is continuous with the slit and is in a different direction from the slit. Surrounding the anchor bolt 9 by the slits alone, or by the slit and the outer side face 17, from at least two directions (or preferably from three or more directions) as above can form the deformable portion.

Also, as mentioned above, to deform the deformable portion more easily, the anchor bolt 9 is preferably disposed close to the center of the base plate 5 as much as possible. Also, it is preferable that a space is formed between a part of the base plate 5 (the outer periphery side) and the foundation 7. In this way, the amount of rotational deformation of the base plate 5 can be increased. An elastic member such as sponge may be disposed in the space.

As above, according to the present embodiment, when an external force is applied to the column body 3, the base plate 5 deforms and allows the rotational deformation of the column base. This can reduce rotational rigidity of the column base. Thus, the foundation 7 can be smaller and less deep, and an amount of steel frame used for the foundation can also be reduced. Thus, an inexpensive column base structure 1 can be obtained.

When the rigidity of the column base structure 1 is reduced, it is still possible to ensure required rigidity as a structure with surplus rigidity for the column body 3 and the beam. As mentioned above, mid-to-low rise buildings in many cases have surplus rigidity for the column body 3 and the like, and thus the conventional column body 3 and the like can be used as they are even when the column base structure 1 of the present invention is applied.

Also, it is only required to form the slits 13*a* and 13*b* in the base plate 5, and surrounding the anchor bolt by the slits 13*a*, 13*b* and the outer side face 17 can form the deformable portion. Thus, the present embodiment is inexpensive and is in a simple structure compared to the conventional pin-connected structure or the like.

Also, fixing the anchor bolt with nuts from above and below the base plate 5 can form a space (including an elastic member) below the base plate 5. Thus, the base plate 5 can be deformed easily.

Also, the anchor bolt 9 is disposed close to the center part of the base plate 5 so as not to be disposed outside a joint area of the column body 3. This can increase the amount of rotational deformation of the base plate 5.

Figure 3:
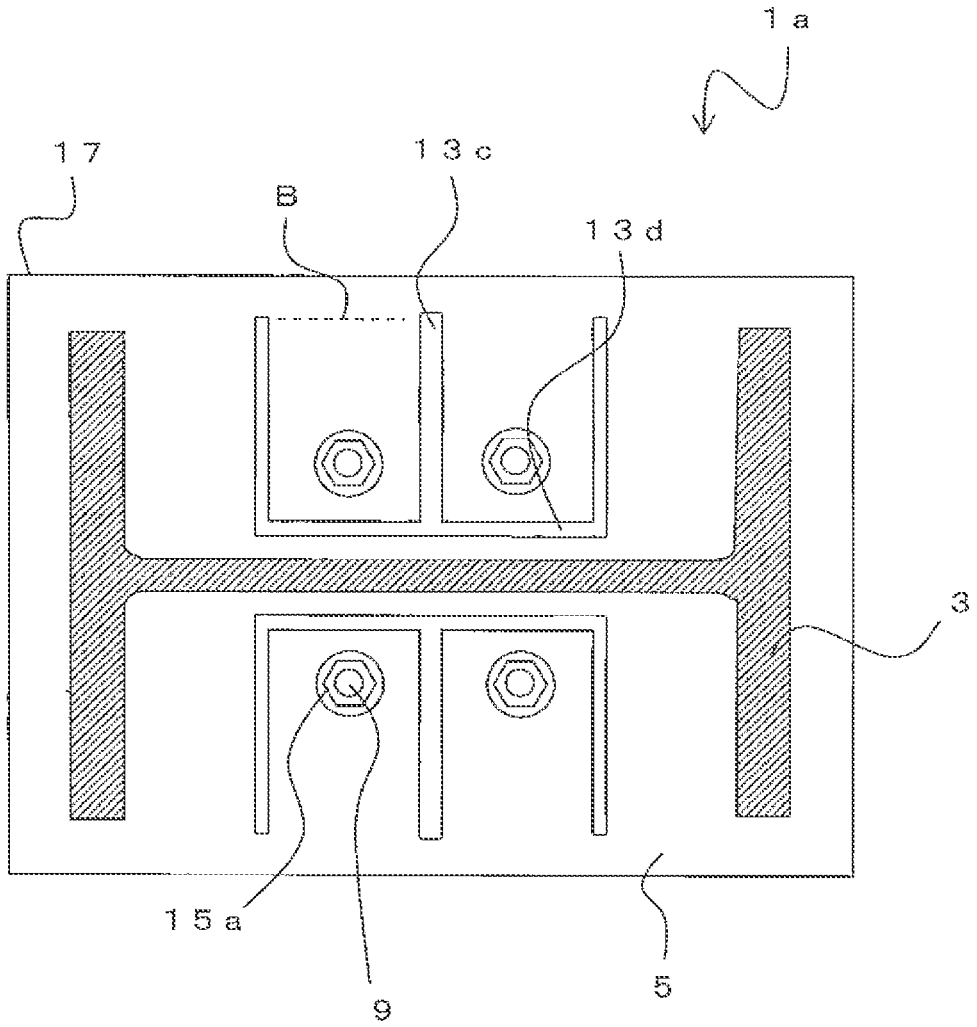
FIG. 3 is a cross sectional view showing a column base structure 1*a*.

Next, a second embodiment will be described. FIG. 3 is a cross sectional view showing a column base structure 1*a* according to the second embodiment. In the descriptions below, structures having the same functions as in the column base structure 1 will have the same notations as in FIG. 1 and FIG. 2 and redundant descriptions will be omitted.

The column base structure 1*a* is approximately similar to the column base structure 1 except for appearance of slits. Slits 13*c* and 13*d* are provided in the column base structure 1*a*. Three slits 13*c* parallel to each other are formed on one side of the base plate 5 in a plan view. Also, the slit 13*d* is formed as one line so as to substantially meet the slits 13*c* at right angles and intersect with tip ends of the three slits 13*c*. That is, the slits 13*c* and 13*d* are continuous with each other, and the slits 13*c* and the slit 13*d* together form a substantially E-shape. Both the slits 13*c* and 13*d* are not continuous with the outer side face 17.

The anchor bolt 9 is surrounded by a pair of the slits 13*c* and the slit 13*d* from three directions. Thus, a deformable portion that connects base portions of the slits 13*c* is formed. As mentioned above, a deformable portion is formed if the anchor bolt 9 is surrounded by continuous slits in at least two directions. Thus, the slit 13*c* may be only one middle slit and the anchor bolt 9 may be disposed within an area surrounded by a line connecting tip ends of the slit 13*c* and 13*d*, the slit 13*c*, and the slit 13*d*.

As above, in the present embodiment, the slits 13*c* and 13*d* are formed so as to surround the anchor bolt 9 and thus the base plate 5 can be deformed easily.

According to the second embodiment, the same effects as in the first embodiment can be obtained. As above, in the present invention, the anchor bolt 9 may be surrounded only by slits without using the outer side face 17.

Figure 4:
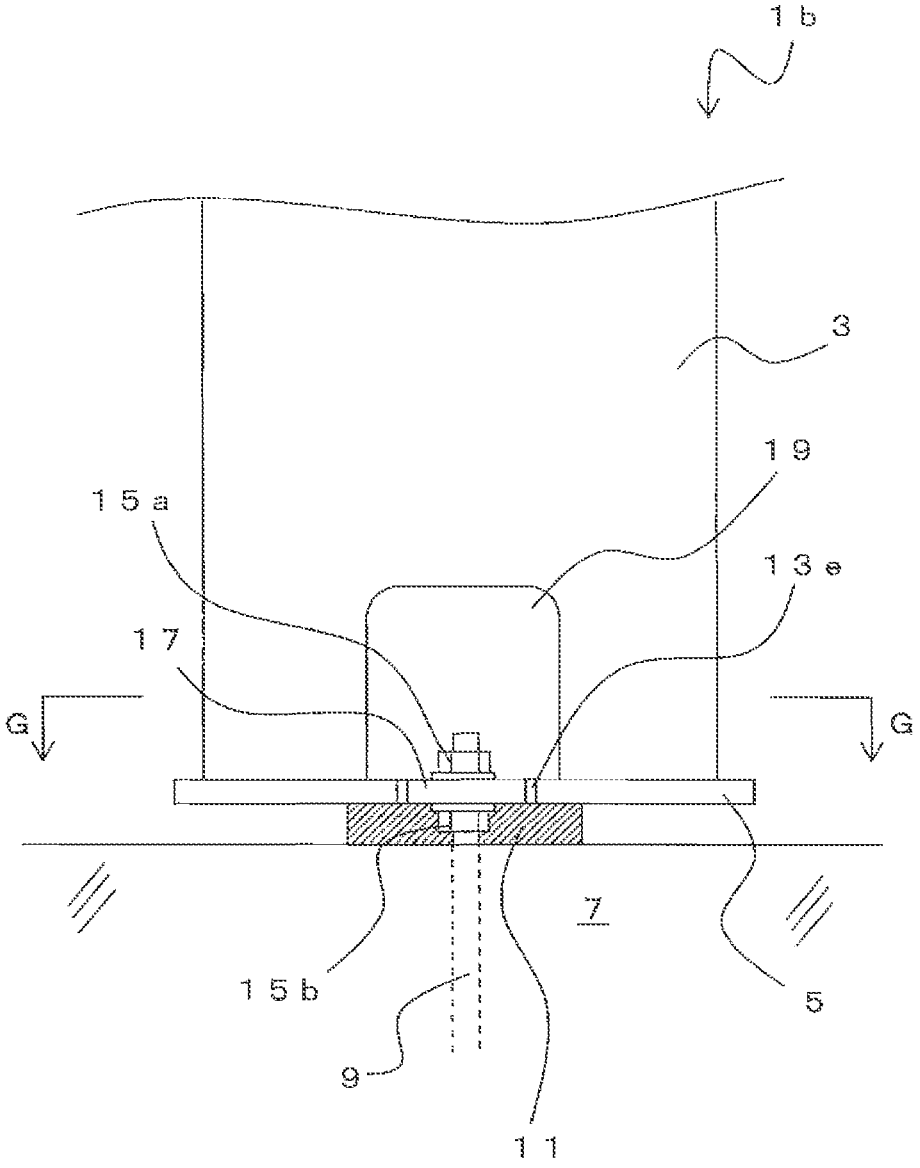
FIG. 4 is a front view showing a column base structure 1*b*.
Figure 5:
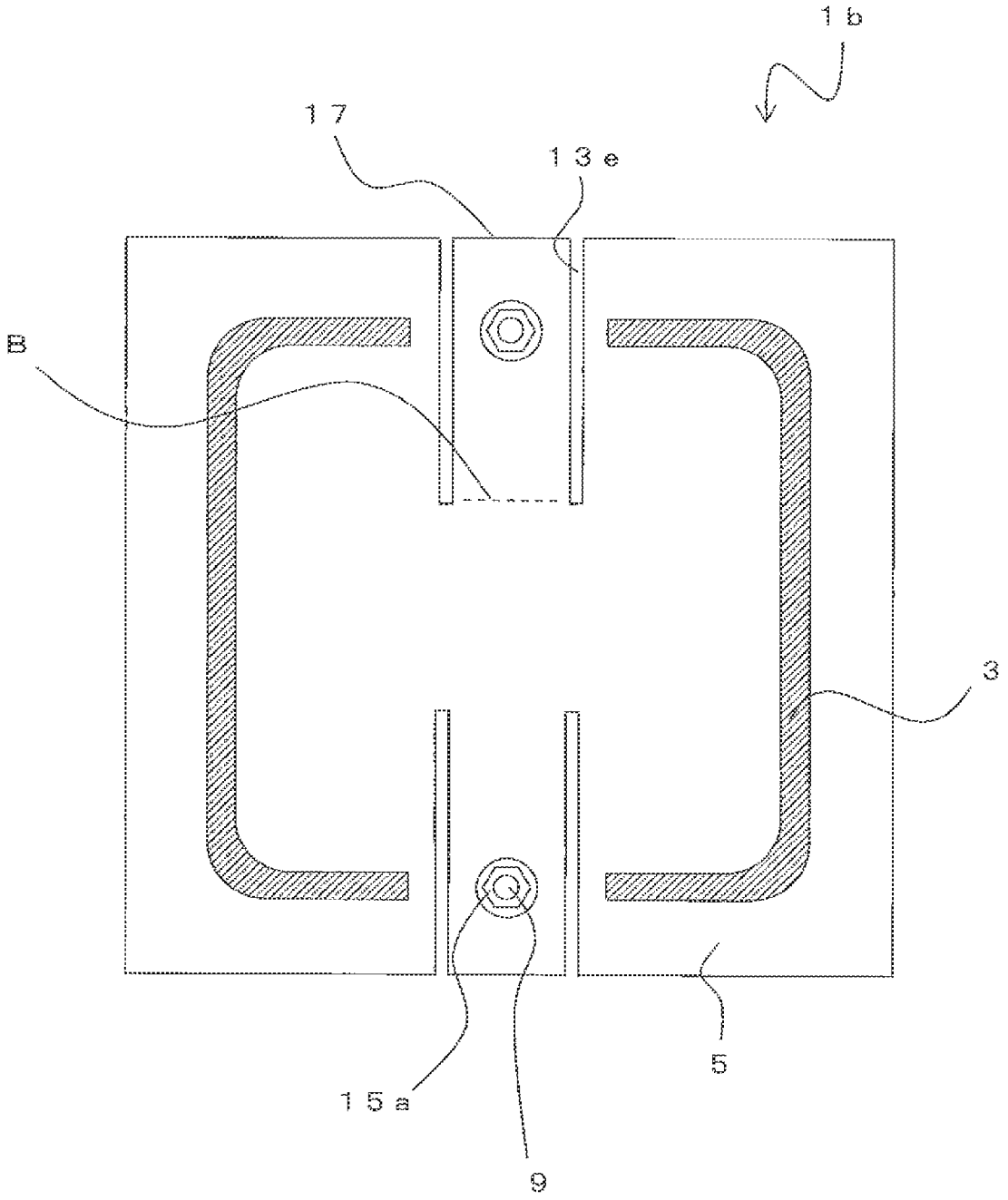
FIG. 5 is a cross sectional view taken along G-G line in FIG. 4 showing the column base structure 1*b*.

Next, a third embodiment will be described. FIG. 4 is a front view showing a column base structure 1*b* according to the third embodiment. FIG. 5 is a cross sectional view taken along G-G line in FIG. 4. The column base structure 1*b* is approximately similar to the column base structure 1 except for appearance of the column body 3 and the slits.

The column body 3 of the column base structure 1*b* is a rectangular column. A cutout 19 is formed at a lower part of the column body 3. As shown in FIG. 5, slits 13*e* are formed at parts of the base plate 5 corresponding to the cutout 19. That is, the slit 13*e* is formed at a part that is not a joint part between the base plate 5 and the column body 3.

The two slits 13*e* parallel to each other are formed for a predetermined length from the outer side face 17 on one side of the base plate 5 in a plan view. The anchor bolt 9 is disposed within an area that is surrounded by the slits 13*e* and the outer side face 17. That is, the anchor bolts 9 on two locations are surrounded by the slits 13*e* and the outer side face 17 that are continuous and formed in different directions, respectively. At this time, a part connecting tip ends of the slits 13*e* becomes a deformable portion.

The column body 3 may be a round column instead of a rectangular column. Also in this case, providing the cutout 19 prevents the column body 3 from interfering with the slits 13*e*.

According to the third embodiment, the same effects as in the first embodiment can be obtained. As above, the present invention is also applicable to rectangular or round columns in addition to H steel columns.

Figure 6:
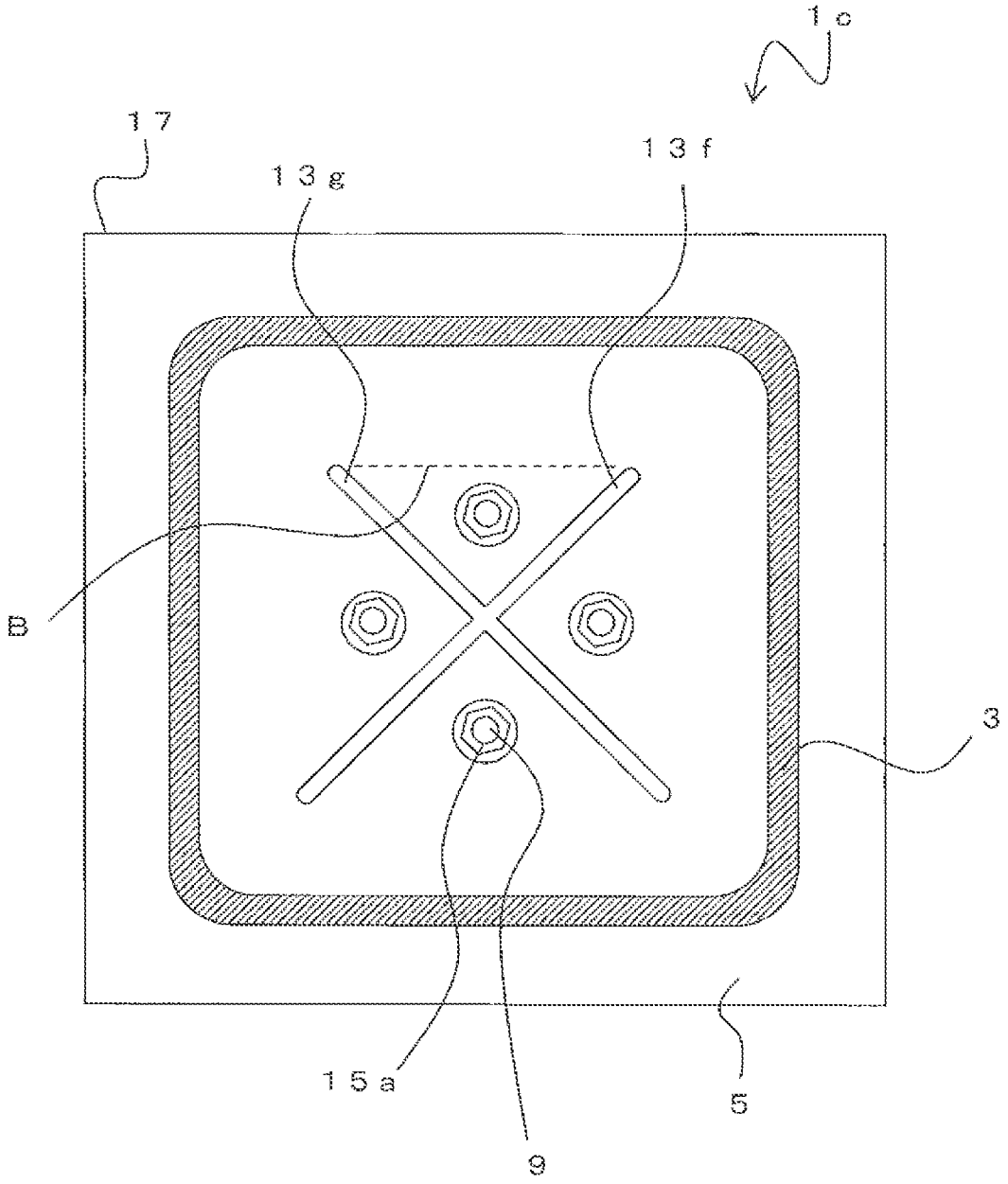
FIG. 6 is a cross sectional view showing a column base structure 1*c*.
Figure 7:
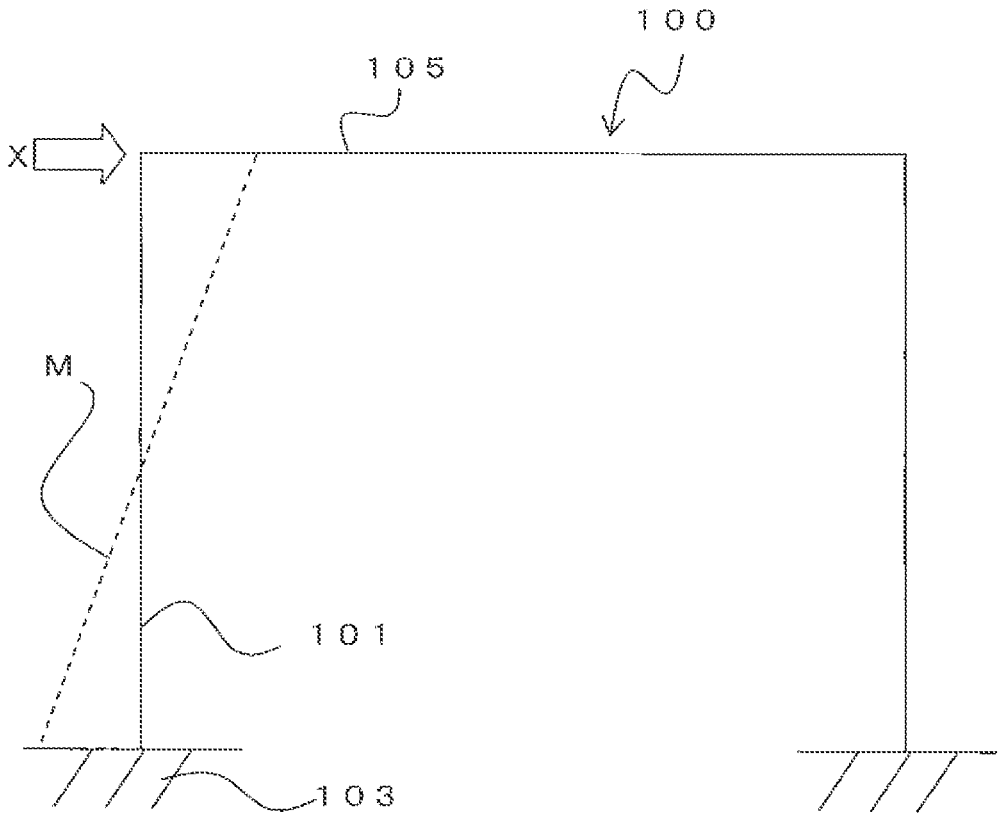
FIG. 7 is a schematic view showing a conventional structure 100.

Next, a fourth embodiment will be described. FIG. 6 is a cross sectional view of a column base structure 1*c*. The column base structure 1*c* is approximately similar to the column base structure 1*b* except that slits 13*f* and 13*g* are formed inside the column body 3.

The slits 13*f* and 13*g* meet each other at substantially right angles and intersect to form a substantially X-shape. The slits 13*f* and 13*g* are not continuous with the outer side face 17 and are formed inside the column body 3. Thus, the cutout 19 is unnecessary for the column body 3 of the present embodiment.

The anchor bolts 9 are disposed on four locations that are divided by the slits 13*f* and 13*g*, respectively. That is, the anchor bolt 9 is surrounded by the continuous slits 13*f* and 13*g* in mutually different directions. In this case, a part connecting tip ends of the slits 13*f* and 13*g* becomes a deformable portion.

According to the fourth embodiment, the same effects as in the first embodiment can be obtained. As above, in the present invention, an area surrounded by the deformable portion and the slits or the like is not necessarily in a rectangular shape, and, also, the slit is not necessarily in a parallel or perpendicular direction to the outer side face 17. Also, although illustrations are omitted, the slit may not be necessarily a straight line but may be in an arc shape. Also in this case, an arc-shaped slit may be taken as a continuous slit in mutually different directions. That is, the anchor bolt may be surrounded from a plurality of directions by a continuous arc-shaped slit in a plurality of different directions.

Although the embodiments of the present invention have been described referring to the attached drawings, the technical scope of the present invention is not limited to the embodiments described above. It is obvious that persons skilled in the art can think out various examples of changes or modifications within the scope of the technical idea disclosed in the claims, and it will be understood that they naturally belong to the technical scope of the present invention.

1, 1*a*, 1*b*, 1*c* . . . column base structure
3 . . . column body
5 . . . base plate
5*a* . . . main body
5*b* . . . hole
7 . . . foundation
8 . . . space
9 . . . anchor bolt
11 . . . mortar
13*a*, 13*b*, 13*c*, 13*d*, 13*e*, 13*f*, 13*g* . . . slit
15*a*, 15*b* . . . nut
17 . . . outer side face
19 . . . cutout
100 . . . structure
101 . . . column

103 . . . foundation

105 . . . beam

What is claimed is:

1. A column base structure for construction comprising:

a column body;

a base plate that is joined to a lower end of the column body, the base plate including a hole through which an anchor bolt is inserted to join the base plate to a foundation, the anchor bolt being fixed to the base plate by using nuts on opposing sides of the base plate, and a space is formed between the base plate and the foundation;

a plurality of slits formed as straight line segments in a plan view and located in vicinity of the anchor bolt in the base plate, each of the plurality of slits being located at a position separate from a joint part disposed between the base plate and the column body; and a deformable portion that is provided on the base plate, the deformable portion being an area on the base plate, when viewed in a plan view, that includes the hole, and a boundary of the area is defined by two successive slits of the plurality of slits.

2. The column base structure for construction according to claim 1, wherein the anchor bolt is formed within at least one width, in a plan view, of the column body that is to be joined to the base plate.

3. A column base structure for construction comprising:

a column body;

a base plate that is joined to a lower end of the column body, the base plate including a hole through which an anchor bolt is inserted to join the base plate to a foundation, the anchor bolt being fixed to the base plate by using nuts on opposing sides of the base plate, and a space is formed between the base plate and the foundation;

a plurality of slits formed as straight line segments in a plan view and located in vicinity of the anchor bolt in the base plate, each of the plurality of slits being located at a position separate from a joint part disposed between the base plate and the column body; and a deformable portion that is provided on the base plate, the deformable portion being an area on the base plate, when viewed in a plan view, that includes the hole, and a boundary of the area is defined by at least one slit of the plurality of slits and an outer side face of the base plate.

4. The column base structure for construction according to claim 3, wherein the anchor bolt is formed within at least one width, in a plan view, of the column body that is to be joined to the base plate.

5. A base plate comprising:

a plate-shaped main body;

a hole through which an anchor bolt is inserted, the hole being provided in the main body, the anchor bolt being fixed to the main body by using nuts on opposing sides of the main body, a space is formed between the main body and a foundation;

a plurality of slits formed as straight line segments in a plan view and located in vicinity of the hole, the plurality of slits being provided in the main body; and a deformable portion provided on the main body, the deformable portion being an area on the main body, when viewed in a plan view, that includes the hole, and a boundary of the area is defined by two successive slits of the plurality of slits.

6. A base plate comprising:

a plate-shaped main body;

a hole through which an anchor bolt is inserted, the hole being provided in the main body, the anchor bolt being fixed to the main body by using nuts on opposing sides of the main body, a space is formed between the main body and a foundation;

a plurality of slits formed as straight line segments in a plan view and located in vicinity of the hole, the plurality of slits being provided in the main body; and a deformable portion provided on the main body, the deformable portion being an area on the main body, when viewed in a plan view, that includes the hole, and a boundary of the area is defined by at least one slit of the plurality of slits and an outer side face of the main body.

* * * * *